US010435893B2

(12) United States Patent
Schlüter

(10) Patent No.: US 10,435,893 B2
(45) Date of Patent: Oct. 8, 2019

(54) METHOD FOR LAYING TILES

(71) Applicant: Werner Schlüter, Iserlohn (DE)

(72) Inventor: Werner Schlüter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 0 days.

(21) Appl. No.: 15/576,185

(22) PCT Filed: Apr. 12, 2016

(86) PCT No.: PCT/EP2016/057983

§ 371 (c)(1),
(2) Date: Nov. 21, 2017

(87) PCT Pub. No.: WO2016/188665

PCT Pub. Date: Dec. 1, 2016

(65) Prior Publication Data

US 2018/0135314 A1 May 17, 2018

(30) Foreign Application Priority Data

May 27, 2015 (EP) ..... 15169438

(51) Int. Cl.
*E04F 21/04* (2006.01)
*E04F 21/02* (2006.01)

(52) U.S. Cl.
CPC ..... *E04F 21/04* (2013.01); *E04F 21/023* (2013.01)

(58) Field of Classification Search
CPC ..... E04F 21/162; E04F 21/04; E04F 21/023; E04F 21/16; E04F 13/02
USPC ..... 33/527
See application file for complete search history.

(56) References Cited

U.S. PATENT DOCUMENTS 2,626,520 A * 1/1953 Whalen ..... E04F 21/04 15/235.5
4,254,980 A * 3/1981 Anderson ..... B05C 17/10 15/235.6
5,363,560 A * 11/1994 Makow ..... E04F 15/02016 33/527
6,223,495 B1 * 5/2001 Shaw ..... E04B 5/40 264/333
6,279,282 B1 * 8/2001 Krionidis ..... E04F 21/04 52/365
6,412,185 B1 7/2002 Mills et al.
(Continued)

FOREIGN PATENT DOCUMENTS

EP 1923524 A1 5/2008

*Primary Examiner* — Paola Agudelo
(74) *Attorney, Agent, or Firm* — Thorpe North & Western, LLP

(57) ABSTRACT

The present invention relates to a method for laying tiles (2) on a laying substrate, in which, initially, tile adhesive (8) is applied to the laying substrate and the tiles (2) are subsequently laid in the tile adhesive (8), characterized in that, before applying the tile adhesive (8) to the laying surface, leveling strips (5) of the same height are affixed so that the top faces of the leveling strips (5) lie in a common reference plane, and in that the tile adhesive (8) is applied between the leveling strips (5) with some protrusion which is then, using a screeding board (9) guided along the top faces of the leveling strips (5), removed down to the level of the reference plane, generating a flat tile adhesive layer (11).

15 Claims, 9 Drawing Sheets

(56) References Cited

U.S. PATENT DOCUMENTS

| | | | | |
|---|---|---|---|---|
| 2003/0196407 | A1* | 10/2003 | Rossi | E04F 21/00 52/749.1 |
| 2004/0049873 | A1* | 3/2004 | Smeja | A47L 13/02 15/236.05 |
| 2005/0076606 | A1* | 4/2005 | Curtis | E04F 21/22 52/741.1 |
| 2007/0227025 | A1* | 10/2007 | Venture | E04F 21/0092 33/527 |
| 2008/0060159 | A1* | 3/2008 | Martin | B25G 1/06 15/235.4 |
| 2010/0186333 | A1* | 7/2010 | Miller | E04F 13/14 52/483.1 |
| 2013/0000246 | A1* | 1/2013 | Bourelle | E04F 21/162 52/745.21 |
| 2014/0115804 | A1 | 5/2014 | Propst | |

* cited by examiner

METHOD FOR LAYING TILES

The present invention relates to a method for laying tiles on a laying substrate in which, first, a tile adhesive is applied to the laying substrate, and, then, the tiles are laid in the tile adhesive. In the present case, the term, "laying substrate," denotes that floor, wall, or ceiling surface, in or on buildings, to which the tile adhesive is applied. The term, "tile," is used in the present case as a generic term for ceramic tiles, mosaic tiles, and also natural and artificial stone slabs.

Tiles have a wide range of applications. They are used as a covering on floors, as well as on walls and ceilings in and on buildings. Here, the tiles usually form a usable area which is exposed to a wide variety of loads, depending upon the type of use. When used outdoors, the tiles are exposed to the alternating stresses of the weather. They thus have to withstand heat, rain, snow, frost, and so on, even in rapid alternation. In industrial or commercial use, tiles must absorb high traffic loads and, in some cases, also be resistant to the effects of chemicals, such as in dairies, in the foodstuffs industry, or in commercial kitchens, to name just a few examples. In addition, in many cases, a floor covering which uses tiles must comply with sound insulation and/or thermal insulation requirements in order to comply with the relevant regulatory requirements. Likewise, it may be necessary to equip a floor covering with a sealing layer against moisture penetration.

In order to meet these diverse and multifarious requirements, and to further innovation, new products have constantly been developed—especially in the ceramics industry. Whereas smaller tile formats between 10×10 cm and a maximum of 30×30 cm prevailed until a few years ago, in line with technical possibilities in production, in recent years, large-format tiles up to 100 cm×300 cm, in material thicknesses between 3 mm and 25 mm, have been developed, wherein the tiles can be made today absolutely flat, with a consistent material thickness. So-called porcelain stoneware with a very low water absorption capacity is predominantly used. The natural stone processing industry has begun to offer natural stone panels, as a relatively thin covering material, of uniform material thickness and in the most varied of formats, up to large format.

For the building designer, there is basically the problem of planning a suitable wall, floor, or ceiling system for the utilization requirement in question and for the covering material selected for this. The floor coverings must then be created on-site by the appropriate construction trades, wherein the covering materials must be laid professionally. The currently applicable regulations for the laying of ceramic tiles and mosaic, natural stone, and artificial stone slabs include mortar laying, as well as thin-bed laying using so-called thin-bed mortar.

According to the regulations for mortar laying, the mortar is applied to the back of the tiles with a layer thickness of at least 15 mm for wall coverings, after which the tiles are then tapped individually to a precise size. For floor coverings, mortar is applied to the laying substrate for one or even more tiles and roughly leveled with a trowel to the desired height, whereupon the tiles are then individually tapped into the mortar bed—for example, with a rubber hammer. The mortar layer must be at least 15 mm, even when laying a floor. Unevenness of the laying substrate is compensated for by varying the mortar thicknesses. Another variant of mortar laying is to make a screed layer, and apply a contact layer to the still fresh screed into which the tiles are tapped to create a flat surface.

Since the 1960's, mortar laying has largely been displaced by thin-bed laying. In thin-bed laying, a distinction is made between three types of tile adhesive: hydraulically-setting, thin-bed mortar, dispersion adhesive, and reactive (two-pack) adhesive. For laying by the thin-bed method, the surface of the laying substrate must be created so as to extend flat on a plane parallel to the subsequent covering surface of the tile covering, wherein the surface of the laying substrate is arranged lower than the tile surface by the material thickness of the tiles and of the adhesive layer. In order to be able to compensate for tolerances of the flatness of the laying substrate and the flatness of the tiles as specified in the appropriate construction standards and material standards, the tile adhesive is applied to the laying substrate with a notched trowel. Notched trowels of this kind have an edge equipped with square teeth, wherein the tooth dimensions usually fall within the range of 3×3 mm up to 12×12 mm. The larger the format of the tile to be laid, the larger the dimensions of the teeth of the notched trowel should be. The tile adhesive is applied by putting tile adhesive on the notched trowel, whereupon the notched trowel is then placed at an angle on the laying substrate and pulled with its teeth over the laying substrate in such a way that the tile adhesive adheres to the laying substrate in the form of tile adhesive ridges. Unevennesses in the laying substrate reveal themselves in the form of different levels of the top faces of the adhesive ridges. The tiles are then laid on the tile adhesive and pressed or tapped such that the top faces of the tiles form a common level. Here, the tile adhesive forming the adhesive ridges spreads into the free spaces between the adhesive ridges as a function of the intensity of pressing or tapping, so that the free spaces fill wholly or partially with tile adhesive, and unevennesses are evened out. However, the free spaces fill very differently with the tile adhesive and the tiles in question can vary in size, which can also lead to differences in adhesive bonding and load-bearing capacities. Moreover, in the case of outdoor floorings, water may accumulate in cavities remaining between the tile adhesive and the tiles and, in the event of frost freeze, can cause damage.

In the case of the so-called floating or buttering method, a thin layer of adhesive is applied to the back of the tile as well, to serve as a contact layer for a better bond between the tile and the adhesive. The disadvantages previously mentioned are not remedied by this, however.

As a result, the multifarious problems in the thin-bed laying of tiles and the new problems emerging in connection with the processing of the recently developed large-size tiles are not, or are only partly, addressed by the applicable codes of practice.

Taking this state of the art as a point of departure, it is an aim of the present invention to create an alternative method for the laying of tiles in the thin bed of the type mentioned at the outset, which at least partially solves the problems described above and which can be employed without problems, even with large-size tiles.

To achieve this aim, the present invention creates a method of the type mentioned at the outset, which is characterized by leveling strips of the same height being attached before the adhesive is applied to the laying substrate in such a way that the top faces of the leveling strips lie on a common reference plane, and by the tile adhesive being applied between the leveling strips so as to project above them, and by the adhesive being removed down to the level of the reference plane by a screeding board pulled over the top face of the leveling strips. A major advantage of the method according to the invention is that, due to the tile adhesive being applied while using leveling strips, a layer of tile adhesive is created upon their removal whose top face extends evenly at the level of the reference plane and upon which the tiles can be laid in a simple manner. Thanks to the use of leveling strips, unevennesses in the substrate can be compensated for, which results in a very uniform bond between the tile adhesive and the individual tiles, thereby achieving a very secure and evenly good attachment of the tiles. Against this background, the method according to the invention is also very well suited for the laying of large-format tiles. Use of leveling strips makes it a simple matter to level the tile adhesive. In combination with the fact that the tiles can also be laid more simply in the tile adhesive layer arranged at a uniform level, with the method according to the invention, an improved tile-laying result is achieved in comparison to conventional methods, even if leveling does represent an additional step. Moreover, given a suitable choice of the height of the leveling strips, only very little tile adhesive is required for attaching the tiles to the laying substrate, which is an advantage with regard to the costs of laying tiles.

To carry out the method according to the invention, a hydraulically-setting, thin-bed mortar or a reactive (two-pack) adhesive is, in particular, suitable as a tile adhesive.

In accordance with one embodiment of the method according to the invention, a tile adhesive is selected which, in the set state, forms a sealing layer and/or a chemically-resistant layer.

The leveling strips are, advantageously, attached to the laying substrate with adhesive or silicone spots and/or adhesive or silicone beads that are arranged on the leveling strips and/or the laying substrate, and aligned with each other flush with the surface. In this way, a simple attachment of the leveling strips is realized. Tile adhesive can be used here as the adhesive.

The leveling strips are advantageously made of plastic. Leveling strips made of plastic can be manufactured economically and simply. Alternatively, the leveling strips can, however, also be made of metal—in particular, of a corrosion-resistant metal alloy.

The leveling strips advantageously have a height in the range of 1-3 mm and/or a width in the range of 10 to 30 mm and/or a length from 1,000 to 3,000 mm. Leveling strips of this kind are handled well and easily.

The cross-section of the leveling strips can be rectangular. For the purpose of saving material, the leveling strips can also have a T-shaped, N-shaped, or M-shaped cross-section, wherein the webs thus formed can also afford an improved attachment of the leveling strips.

In accordance with one embodiment of the present invention, the leveling strips are affixed to the laying substrate at a distance from the subsequent tile joints—in particular, at a distance of at least 30 mm. Problems during grouting are thus avoided. Furthermore, it is ensured that there is proper attachment around the edges of the tiles. The width of a leveled section should be at least the width or length of a tile to be laid, or a multiple of the width or length of a tile to be laid.

According to one variant of the present invention, the leveling strips are provided with through-holes. This is beneficial when the leveling strip are to remain in the tile adhesive layer after tile adhesive has been removed, since the through-holes then fill with tile adhesive and are thus securely embedded in the tile adhesive layer. Alternatively, the leveling strips can be removed even after screeding. In this case, the free space which remains in the tile adhesive layer after removal of the leveling strips must be filled up with tile adhesive. The removal of the leveling strips means more effort. On the other hand, the leveling strips can, however, be used again.

The screeding board is rigid and advantageously made of metal—in particular, aluminum.

According to one variant according to the invention, a screeding board with a beveled, straight-extending screeding edge is used with which the tile adhesive is screeded down to the level of the reference plane, producing a flat layer of tile adhesive.

According to an alternative variant of the invention, a screeding board with a serrated screeding edge is used, wherein the serration, in particular, corresponds to that of a notched trowel with dimensions in the range of 1 to 3 mm, wherein the tile adhesive is scraped away down to the level of the reference plane, generating a layer of tile adhesive which is ribbed in a way corresponding to the serration.

In accordance with one embodiment of the present invention, the tiles are tapped into the tile adhesive layer and/or pressed into the tile adhesive layer using a vibration-generating device. Tapping the tiles into the tile adhesive layer can be done, for example, by using a rubber hammer. A conventional orbital sander can be used as a vibration-generating device whose rubberized face can be guided under pressure over the surface of the tiles. The vibrations cause even the smallest cavities between the tile adhesive layer and the tile to close, thereby creating a good, full-area adhesive bond.

In accordance with one embodiment of the present invention, a contact layer is applied to the backs of the tiles before the tiles are laid on the tile adhesive layer, wherein the contact layer is preferably made of the same material as the tile adhesive layer. Alternatively, the contact layer can also be made of a higher quality material that is compatible with the tile adhesive layer, in order to achieve an optimization of the adhesive bond with the tile. The contact layer can also be made of a liquid material, compatible with the tile adhesive, with a layer thickness in the range of 0.1 to 0.5 mm. Applying a contact layer is especially advantageous when installing large tiles, thereby further improving the adhesion between the tile and the tile adhesive layer. However, applying a contact layer can also be useful when laying tiles with smaller formats—especially if the backs of the tiles are structured, as is often the case. In this case, the contact layer is used for leveling the backs of the tiles.

The contact layer is preferably smoothed or brushed on. Smoothing-on is done, advantageously, with a smoothing trowel or a serrated trowel with very fine teeth, e.g., with teeth in the range of 0.5 to 3 mm. The contact layer can be applied with, for example, a wide brush or a fleece roller.

The contact layer is, advantageously, applied in a thickness in the range of 0.5 to 2 mm—in particular, in a thickness of 1 mm. A liquid contact layer may be thinner and can, for example, be 0.1 to 0.5 mm.

The laying substrate is advantageously formed by one or more decoupling mats or by support panels. Laying substrates so formed, on the one hand, offer sufficient load-bearing capacity and, on the other, prevent tensions from arising within the laying substrate, or prevent pre-existing tensions within the laying substrate from being transmitted to the tiles.

In accordance with one variant of the present invention, the tiles have an edge length of at least 500 mm. In other words, large format tiles are processed in this variant.

It is also proposed that leveling strips be used to carry out the method according to the invention.

In addition, a screeding board with a length of at least 50 cm—in particular, of at least 100 cm—is proposed which has a mainly T-shaped cross-section, wherein a first free end of the T-shaped cross-section defines a first beveled, straight-extending screeding edge, a second free end of the T-shaped cross-section defines a second screeding edge provided with teeth, and a third free end of the T-shaped cross-section defines a grip area.

Other features and advantages of the present invention will become clear on the basis of the following description of an embodiment of a method according to the invention, with reference to the enclosed drawing. Here, FIG. 1 shows a schematic, perspectival view of a wall structure with leveling strips arranged on it;

Figure 1:
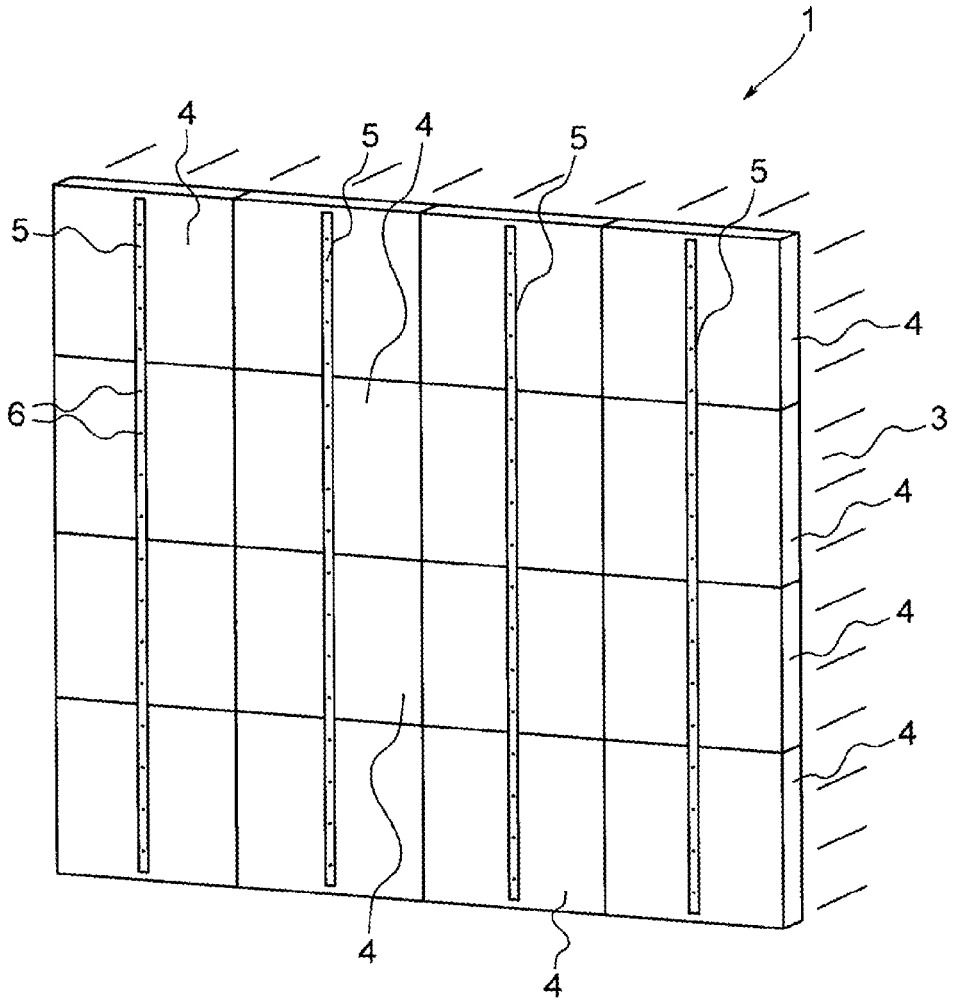

FIG. 1 shows a wall structure 1, which is to be covered with tiles 2. The wall structure consists of a wall 3 and support panels 4 mounted thereon. In the present case, the support panels 4 comprise a core layer of foamed insulating material that is coated on its front and back in each case with a reinforcing layer and a fleece layer. The support panels 4 can be bolted or dowelled to the wall 3. Alternatively, they can even be glued to the wall 3—for example, using a tile adhesive. In the latter case, the fleece layer on the back of the support panel 4 can serve as an adhesive surface.

Figure 2:
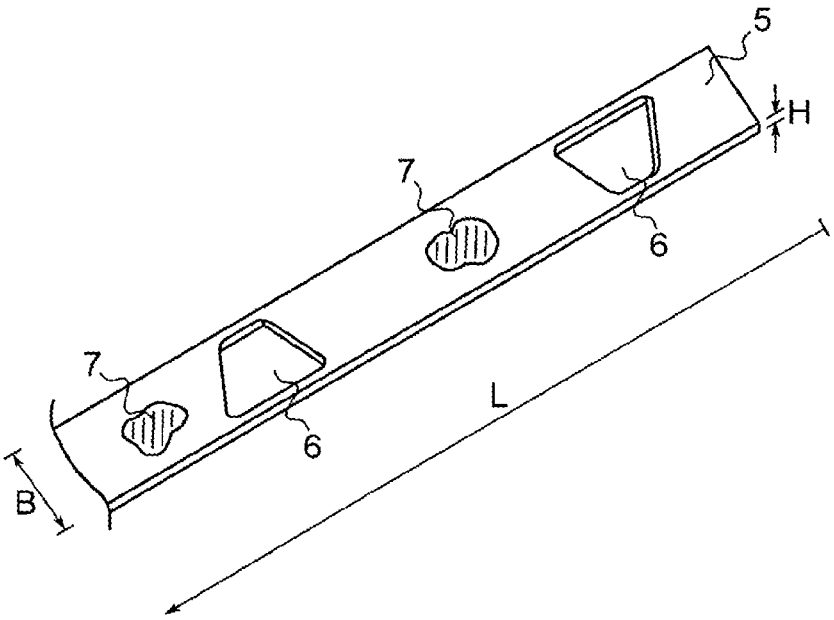
FIG. 2 shows a schematic, perspectival view of part of a leveling strip with spots of adhesive arranged on it.

To fasten tiles 2 to the front faces of the support panels 4 that define a level laying substrate, in a first step of an embodiment of the method according to the invention, leveling strips 5 are affixed to the support panels 4 with approximately even spacing and essentially parallel to each other. The leveling strips 5 shown in FIG. 2 are made of plastic and have a constant, rectangular cross-section over their length L. The length L of the leveling strips, as delivered, is 3,000 mm, the height H 2 mm, and the width B 20 mm. The leveling strips 5 are equipped with a plurality of through-holes 6, which in the present case have a trapezoidal cross-section, but other cross-sections are also conceivable. To fasten the leveling strips 5 to the support panels 4, they are shortened in a first step to match them to the height of the wall 3. In a further step, adhesive spots 7 are arranged on the back of the leveling strips 5, whereupon the leveling strips 5 are pressed with their backs to the support panels 4. The individual leveling strips 5 are attached in such a way that they are essentially parallel to one another. In addition, the leveling strips 5 are, by being pressed onto the adhesive spots 7, aligned with each other in such a way that their top faces lie in a common reference plane (see FIG. 1).

At this point, it should be noted that, instead of adhesive spots, spots of silicone can be used—as also adhesive or silicone beads—to fasten the leveling strips 5 to the support panels 4. In addition, the spots of adhesive or silicone, or the beads of adhesive or silicone, can also be applied to the support panels.

Figure 3:
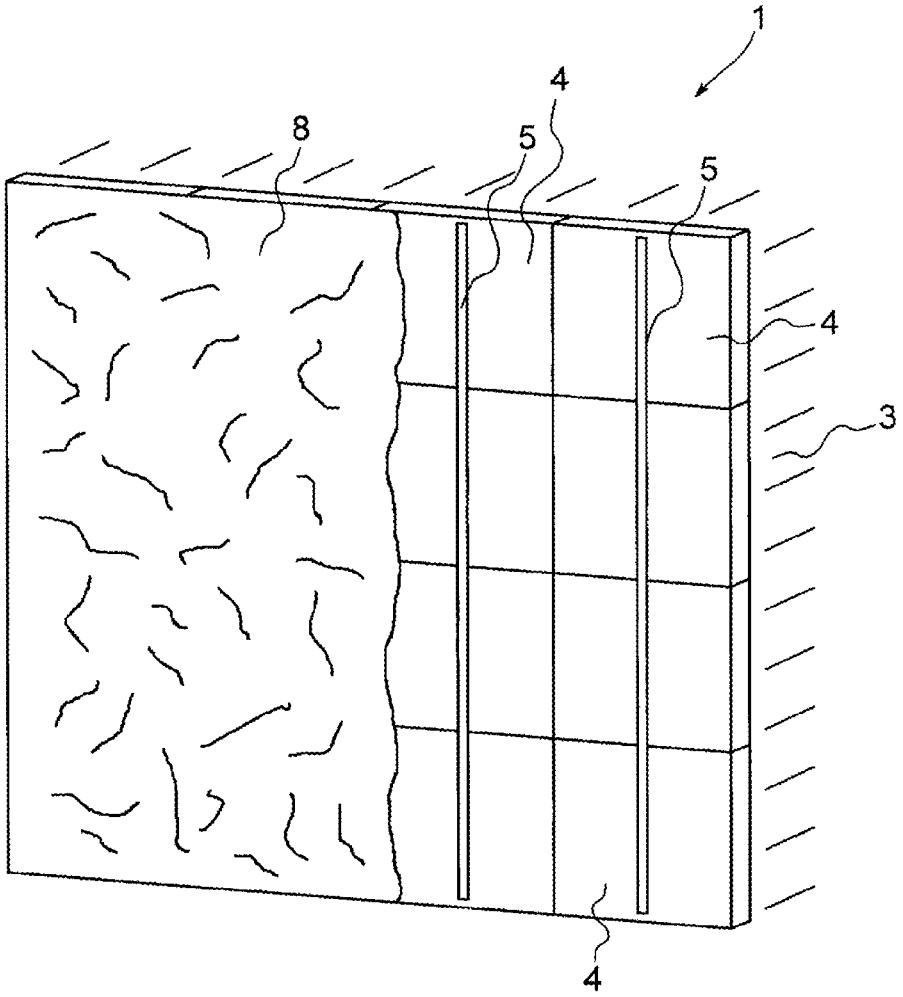
FIG. 3 shows a view of the wall structure, shown in FIG. 1, to which a layer of tile adhesive has been applied.

In a further step, as shown in FIG. 3, a tile adhesive 8, which in this case is a hydraulically-setting, thin-bed mortar, is applied over the full area between the leveling strips 5 and projects above the top faces of the leveling strips 5. Alternatively, a reactive (two-pack) adhesive can also be used instead of the hydraulically-setting, thin-bed mortar.

Figure 4:
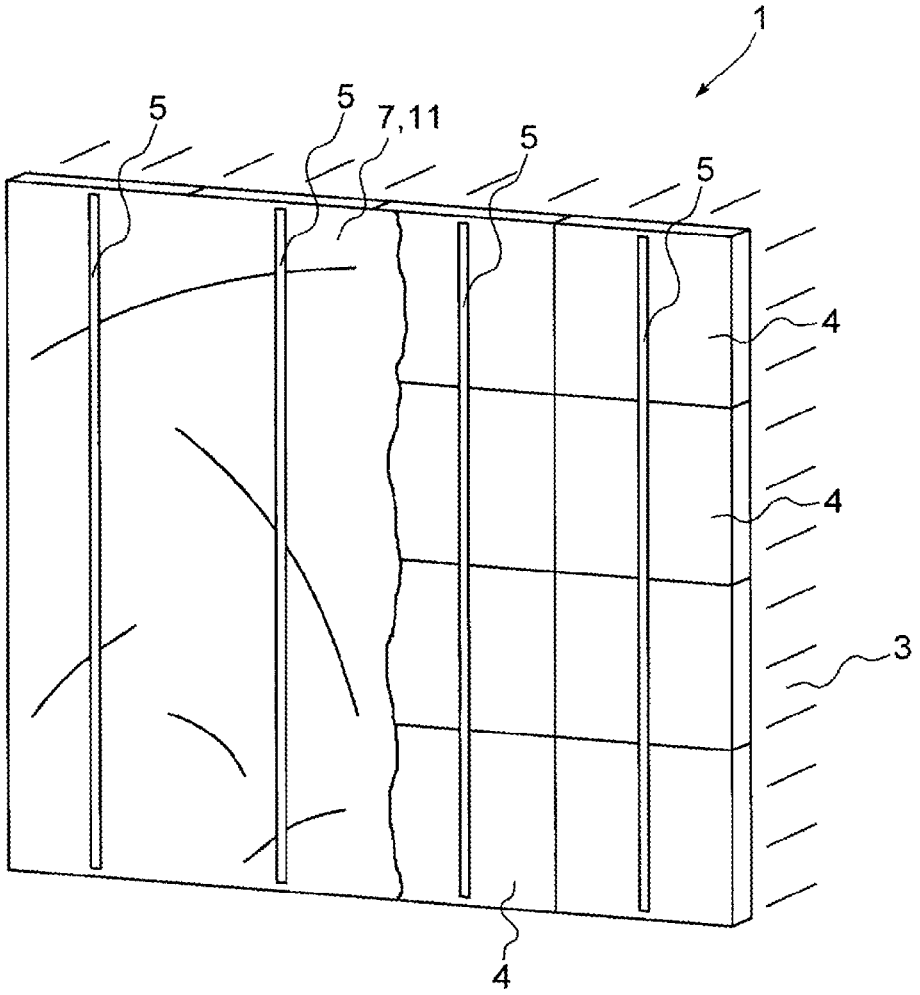
FIG. 4 shows a view of the wall structure, shown in FIG. 3, where the tile adhesive layer has been screeded.
Figure 5:
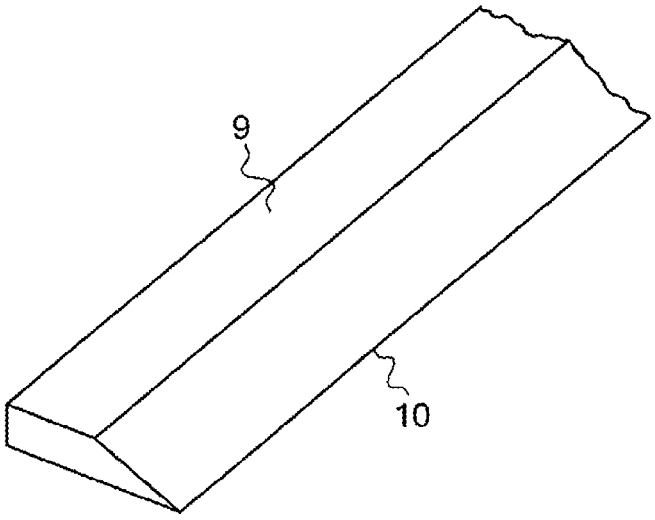
FIG. 5 shows a schematic, perspectival view of part of a screeding board.

Now, the tile adhesive 8 is screeded down to the level of the reference plane by means of a screeding board 9 pulled over the top faces of the leveling strips 5, as shown schematically in FIG. 4. The screeding board 9 shown in FIG. 5 is made of metal—in this case, of aluminum—to give the right stiffness, has a length which is at least greater than the distance between two adjacent leveling strips 5, and has a beveled screeding edge 10, which, during screeding, is moved at an angle of approximately 45° over the surfaces of the leveling strips 5. In this way, an entirely flat tile adhesive layer 11 is achieved.

Figure 6:
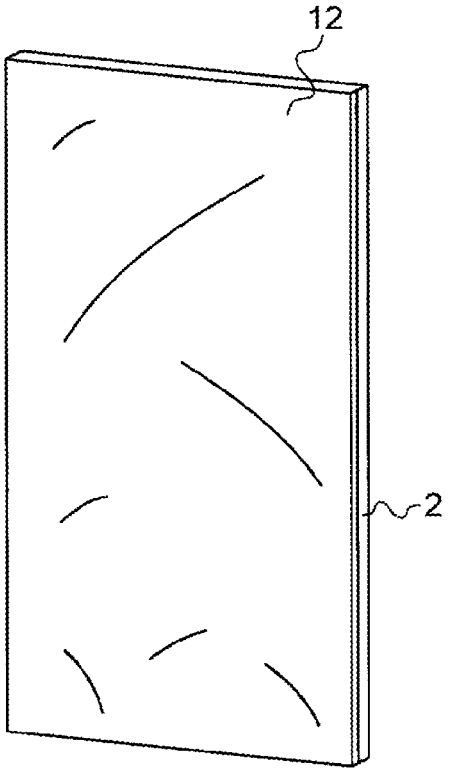
FIG. 6 shows a schematic, perspectival view of a tile provided with a contact layer.

In a further step, as shown in FIG. 6, a contact layer 12 is applied to the backs of the tiles 2 which is made of the same material as the tile adhesive 8, the tiles as delivered having, in the present case, dimensions of 600×1,200×8 mm. For this purpose, the tile adhesive is spread evenly over the back of the tile 2 using, for example, a smoothing trowel or a very finely serrated, notched trowel in such a way that the contact layer has a thickness of 1.0 mm. At this point, it should be noted that, in principle, tiles with other dimensions can be used. Also, the contact layer 12 may consist of a different material than the tile adhesive 8, so long as the material is compatible with the tile adhesive 8. Accordingly, a higher quality, hydraulically-setting, thin-bed mortar, for example, can be used. In addition, a different thickness can be selected for the contact layer 12—for example, a thickness of 0.5 or 2.0 mm. A liquid contact layer can also be very thin—for example, in the range of 0.1 to 0.5 mm.

Figure 7:
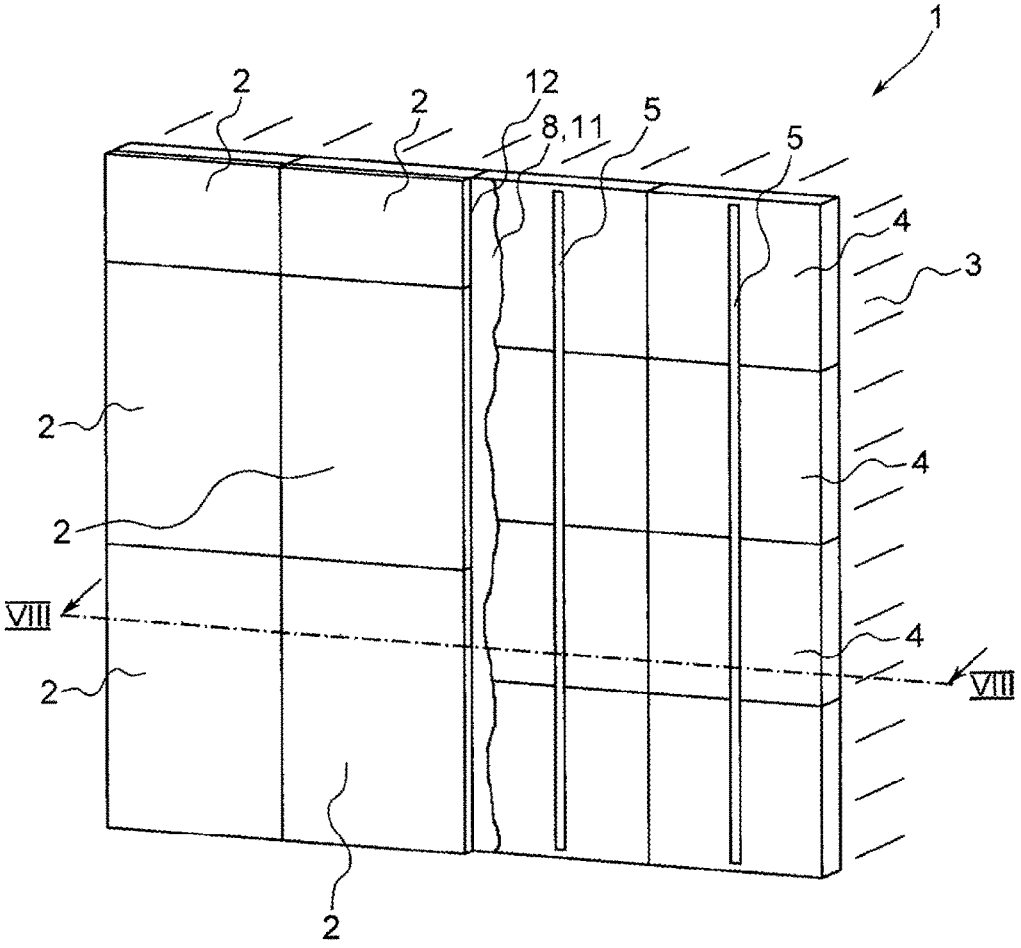
FIG. 7 shows a view of the wall structure, shown in FIG. 4, in which tiles are attached to the screeded layer of tile adhesive shown in FIG. 6.

In a following step, the tile 2 according to FIG. 7 is pressed with its back in its intended position—where applicable, with the contact layer 12 first—onto the tile adhesive layer 11 and lightly tapped using a rubber hammer. Next, the rubberized surface of an orbital sander is moved over the entire surface of the tile 2 under pressure, so that the contact layer and the tile adhesive layer 11 connect to each other without cavities.

Figure 8:
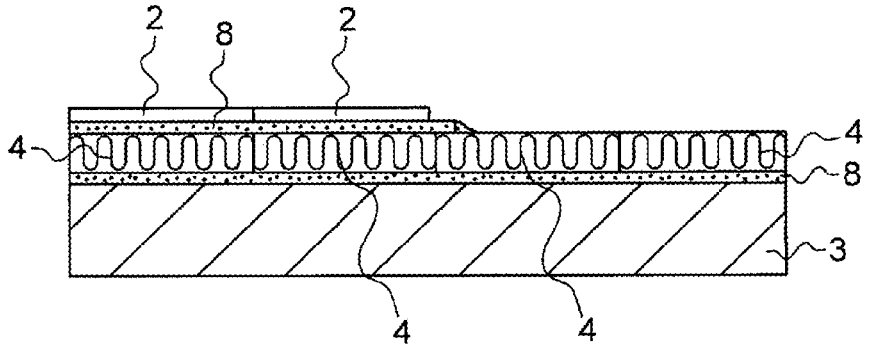
FIG. 8 shows a sectional view along the line VIII-VIII in FIG. 7.

The steps described above are repeated until the entire wall structure is covered with tiles 2, which is not further illustrated in the figures. In this way, the structure shown in FIG. 8 is achieved.

A significant advantage of the method according to the invention is that, after screeding, a completely flat tile adhesive layer 11 is produced by the application of tile adhesive using the leveling strips 5, onto which the tiles 2 can be laid. On the one hand, this results in it being possible to ensure void-free tile-laying, which means that a very secure fastening and load-bearing capacity of the tiles 2 is achieved, which is why the method according to the invention is particularly well suited for the laying of large-format tiles. On the other hand, with a suitable choice of the height H of the leveling strips 5, only very little tile adhesive 8 is required for attaching the tiles 2 to the laying substrate, which is advantageous in terms of the cost of tile-laying.

Figure 9:
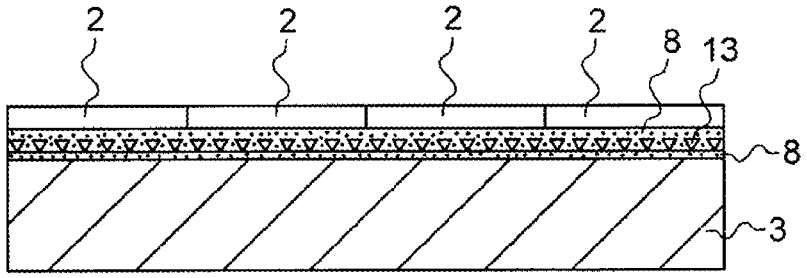
FIG. 9 shows a sectional view of an alternative wall structure in accordance with one embodiment of the present invention.

FIG. 9 shows a wall structure according to an alternative embodiment of the present invention, wherein the same reference numerals are used for the same components as in the previous figures. The wall structure shown in FIG. 9 differs from the wall structure described with reference to FIGS. 1 through 8 only in that a decoupling mat 13 is affixed directly on the wall 3, using a tile adhesive 8, and forms the laying substrate for the tiles 2. Such decoupling mats 13 are known from prior art and, in the present case, serve to decouple the tiles 2 from the wall 3, so that shear forces acting within the tile plane and the wall plane cannot be transferred from the wall 3 to the tiles 2, or vice versa. As an example of such a decoupling mat 13, the product, "DITRA," from Schlüter-Systems KG may be mentioned, but of course other decoupling mats can be used as well.

Figure 10:
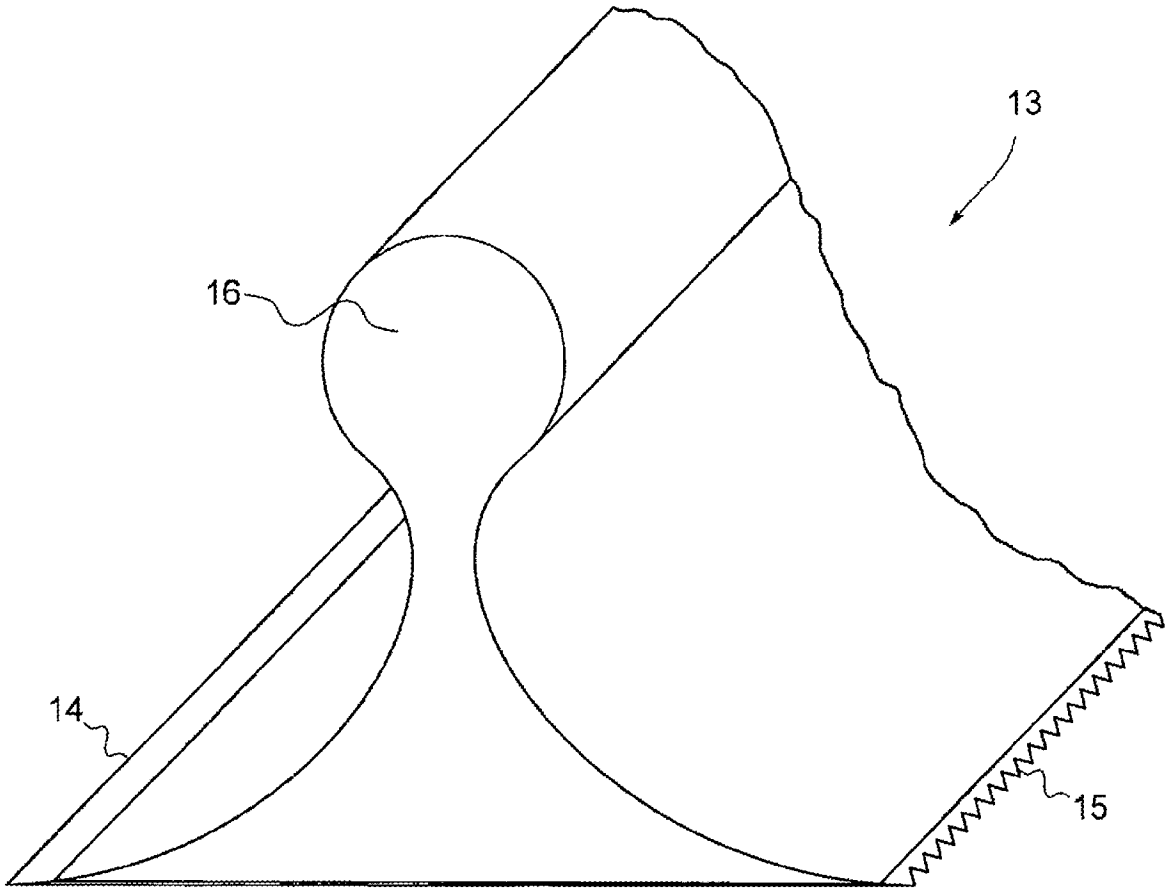
FIG. 10 shows a schematic, perspectival view of part of a screeding board in accordance with one embodiment of the present invention.

FIG. 10 shows a screeding board 13 in accordance with one embodiment of the present invention, which is made of metal—in this case, of aluminum—to give the right stiffness. The screeding board 13 has a length great enough to bridge the distance between adjacently-arranged leveling strips 5. The length of the screeding board 13 is at least 50 cm—in particular, at least 100 cm. The screeding board 13 has a mainly T-shaped cross-section, wherein a first free end of the T-shaped cross-section defines a first beveled, straight-extending screeding edge 14, a second free end of the T-shaped cross-section defines a second screeding edge 15 provided with teeth, and a third free end of the T-shaped cross-section defines a grip area 16. The teeth have a size between 1 to 3 mm. The grip area 16 is ergonomically shaped so that it can be easily gripped, and may be made of a different material from the remainder of the screeding board 13, such as plastic or wood. The method described above can be carried out with the screeding board 13 using the straight screeding edge 14, in a manner analogous to that of the screeding board 9. Alternatively, however, the tile adhesive 8 can also be removed down to the level of the reference plane with the serrated second screeding edge 15, producing a ribbed layer of tile adhesive corresponding to the serration.

Although the invention has been further illustrated and described in detail via a preferred embodiment, the invention is not limited by the disclosed examples, and variations other than wall, floor, or ceiling constructions with tile coverings can be deduced therefrom by those skilled in the art, without departing from the protected scope of the invention.

LIST OF REFERENCE NUMBERS

1 Wall structure
2 Tile
3 Wall
4 Support panel
5 Leveling strip
6 Through-hole
7 Spot of adhesive
8 Tile adhesive
9 Screeding board
10 Screeding edge
11 Tile adhesive layer
12 Contact layer
13 Screeding board
14 First screeding edge
15 Second screeding edge
16 Grip area

The invention claimed is:

1. A method of laying tiles (2) on a laying substrate, comprising:

affixing leveling strips (5) having a common height to the laying substrate such that top faces of the leveling strips (5) lie in a common reference plane, the leveling strips (5) having a height (H) in the range of 1 to 3 mm;

applying tile adhesive (8) between the leveling strips (5);

removing adhesive to the level of the common reference plane using a screeding board (9; 13) guided along the top faces of the leveling strips (5); and laying the tiles (2) in the tile adhesive (8).

2. The method according to claim 1, wherein the tile adhesive (8) is hydraulically-setting, thin-bed mortar or a reactive (two-pack) adhesive.

3. The method according to claim 1, further comprising selecting the tile adhesive (8) such that it forms a sealing layer and/or a chemically-resistant layer in the set state.

4. The method according to claim 1, further comprising attaching the leveling strips (5) to the laying substrate with adhesive or silicone spots (7) and/or adhesive or silicone beads that are applied to the leveling strips (5) and/or the laying substrate, affixed to the laying substrate, and aligned with the top faces of the leveling strips flush with each other.

5. The method according to claim 1, wherein the leveling strips (5) are made of plastic or a corrosion-resistant metal alloy.

6. The method of claim 1, wherein the leveling strips (5) have a width (B) in the range of 10 to 30 mm and/or a length (L) of 1,000 to 3,000 mm.

7. The method according to claim 1, wherein the leveling strips (5) have a rectangular, T-shaped, N-shaped, or M-shaped cross-section.

8. The method according to claim 1, wherein the screeding board (9; 13) is rigid and formed of aluminum, and/or the screeding board (9; 13) has a beveled, straight-extending screeding edge (10; 14) with which the tile adhesive (8) is removed down to the level of the reference plane to generate a flat tile adhesive layer (11).

9. The method according to claim 1, wherein the screeding board (9; 13) includes a serrated screeding edge (14), wherein toothing of the serrated screeding edge corresponds to a notched trowel with dimensions in the range of 1 to 3 mm, and wherein the step of removing adhesive further comprises removing adhesive with the serrated screeding edge down to the level of the reference plane to generate a layer of tile adhesive which is ribbed in a manner corresponding to the serrated screeding edge.

10. The method according to claim 1, wherein laying the tiles further comprises tapping the tiles (2) into a tile adhesive layer (11) and/or pressing the tiles (2) into the tile adhesive layer (11) using a vibration-generating device.

11. The method according to claim 1, further comprising applying a contact layer (12) to the rear sides of the tiles (2) before the tiles (2) are laid in a tile adhesive layer (11), wherein the contact layer (12) is formed from the same material as the tile adhesive layer (11), or is made of a liquid material, compatible with the tile adhesive.

12. The method according to claim 11, wherein applying the contact layer (12) to the rear sides of the tiles (2) before the tiles (2) are laid in a tile adhesive layer (11) further comprises applying the contact layer with a layer thickness in the range of 0.1 to 0.5 mm.

13. The method according to claim 11, wherein applying the contact layer (12) to the rear sides of the tiles (2) before the tiles (2) are laid in a tile adhesive layer (11) further comprises applying the contact layer with a layer thickness in the range of 0.5 to 2 mm.

14. The method according to claim 1, wherein the laying substrate is formed by one or more decoupling mats or by support panels.

15. The method according to claim 1, wherein the tiles (2) have an edge length of at least 500 mm.

* * * * *